US011957990B2

(12) United States Patent
Shields et al.

(10) Patent No.: US 11,957,990 B2
(45) Date of Patent: Apr. 16, 2024

(54) PORTABLE WATER SPORTS ENVIRONMENT

(71) Applicants: Kenneth Allen Shields, Cottonwood Heights, UT (US); Kenneth Steven Shields, Sandy, UT (US); Kirk Patrick Laplante, Sandy, UT (US)

(72) Inventors: Kenneth Allen Shields, Cottonwood Heights, UT (US); Kenneth Steven Shields, Sandy, UT (US); Kirk Patrick Laplante, Sandy, UT (US)

( * ) Notice: Subject to any disclaimer, the term of this patent is extended or adjusted under 35 U.S.C. 154(b) by 302 days.

(21) Appl. No.: 17/298,560

(22) PCT Filed: Nov. 27, 2019

(86) PCT No.: PCT/US2019/063716
§ 371 (c)(1),
(2) Date: May 29, 2021

(87) PCT Pub. No.: WO2020/113078
PCT Pub. Date: Jun. 4, 2020

(65) Prior Publication Data

US 2022/0016535 A1 Jan. 20, 2022

Related U.S. Application Data

(60) Provisional application No. 62/773,051, filed on Nov. 29, 2018.

(51) Int. Cl.
*A63G 31/00* (2006.01)
*B63B 34/70* (2020.01)
*A63B 69/00* (2006.01)

(52) U.S. Cl.
CPC ..... *A63G 31/007* (2013.01); *B63B 34/70* (2020.02); *A63B 69/0093* (2013.01);
(Continued)

(58) Field of Classification Search
CPC ..... A61G 31/007; A63B 2210/50; A63B 69/0093; B63B 34/70
(Continued)

(56) References Cited

U.S. PATENT DOCUMENTS 5,401,117 A * 3/1995 Lochtefeld ..... A63B 69/0093 4/491
6,019,547 A * 2/2000 Hill ..... A63G 31/007 4/491

(Continued)

FOREIGN PATENT DOCUMENTS

GB 2547192 A * 8/2017
WO 2008090313 A2 7/2008
WO 2020113078 A1 6/2020

OTHER PUBLICATIONS

International Search Report and Written Opinion for International Application No. PCT/US2019/063716, dated Feb. 6, 2020, 11 pages.

(Continued)

*Primary Examiner* — Tuan N Nguyen
(74) *Attorney, Agent, or Firm* — Ryan L. Marshall; Barnes & Thornburg LLP

(57) ABSTRACT

A portable water sports environment is provided. The environment includes a mat positioned on a liner. The front end of the liner may be positioned proximate to a body of water. The back end of the liner may be positioned distally to the body of water. A spray nozzle positioned along a front end of the liner may spray water from the body of water onto the mat and toward the back end of the liner. The environment may a ballast positioned on the top surface of the liner and spaced from the mat. The mat, the top surface of the liner, and the ballast may define a trench that extends away from the back end of the liner and toward the front end of the liner.

(Continued)

The trench may guide water received from the spray nozzle toward the front end of the liner and into the body of water.

20 Claims, 4 Drawing Sheets

(52) U.S. Cl.
CPC ..... *A63B 2208/03* (2013.01); *A63B 2210/50* (2013.01); *A63B 2225/62* (2013.01)

(58) Field of Classification Search
USPC ..... 4/491, 498, 503, 585
See application file for complete search history.

(56) References Cited

U.S. PATENT DOCUMENTS

| | | | |
|---|---|---|---|
| 7,666,104 | B2 | 2/2010 | Lochtefeld |
| 7,722,290 | B2 | 5/2010 | Johnson |
| 8,641,543 | B2 | 2/2014 | Lochtefeld |
| 9,908,057 | B2 | 3/2018 | McCarthy |
| 2015/0057093 | A1 | 2/2015 | Murphy |
| 2017/0136368 | A1 | 5/2017 | Koide et al. |

OTHER PUBLICATIONS

International Preliminary Report on Patentability for International Application No. PCT/US2019/063716, dated May 25, 2021, 10 pages.

* cited by examiner

PORTABLE WATER SPORTS ENVIRONMENT

CROSS-REFERENCE TO RELATED U.S. APPLICATION

This application is a National Stage application of International Application No. PCT/US2019/063716, filed Nov. 27, 2019, which claims priority to U.S. provisional patent application No. 62/773,051 filed on Nov. 29, 2018. The disclosure of each of which is hereby expressly incorporated by reference in their entirety.

TECHNICAL FIELD

This disclosure relates to water sports environments and, in particular, to portable water sports environments.

BACKGROUND

An artificial water sports environment may induce water movement for water sports activities such as surfing, water skiing, body boarding, or other surface waters sports. The water movement may include, for example, an artificial wave or a stream of pressurized water. Flowing water may provide resistance or buoyancy for an enthusiast to perform the water sports activity. The artificial water sports environment may be assembled and remain stationary in a location such as an amusement park or other facility. Specialized pumps and large water reservoirs may inhibit mobilization of the water sports environments between locations. Moreover, artificial water sports environments may include rigid and bulky structures which are not designed to be repeatedly deployed, undeployed, and stored between uses. Accordingly, there is a need for inventive systems, methods, components, and apparatuses described herein.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Figure 1:
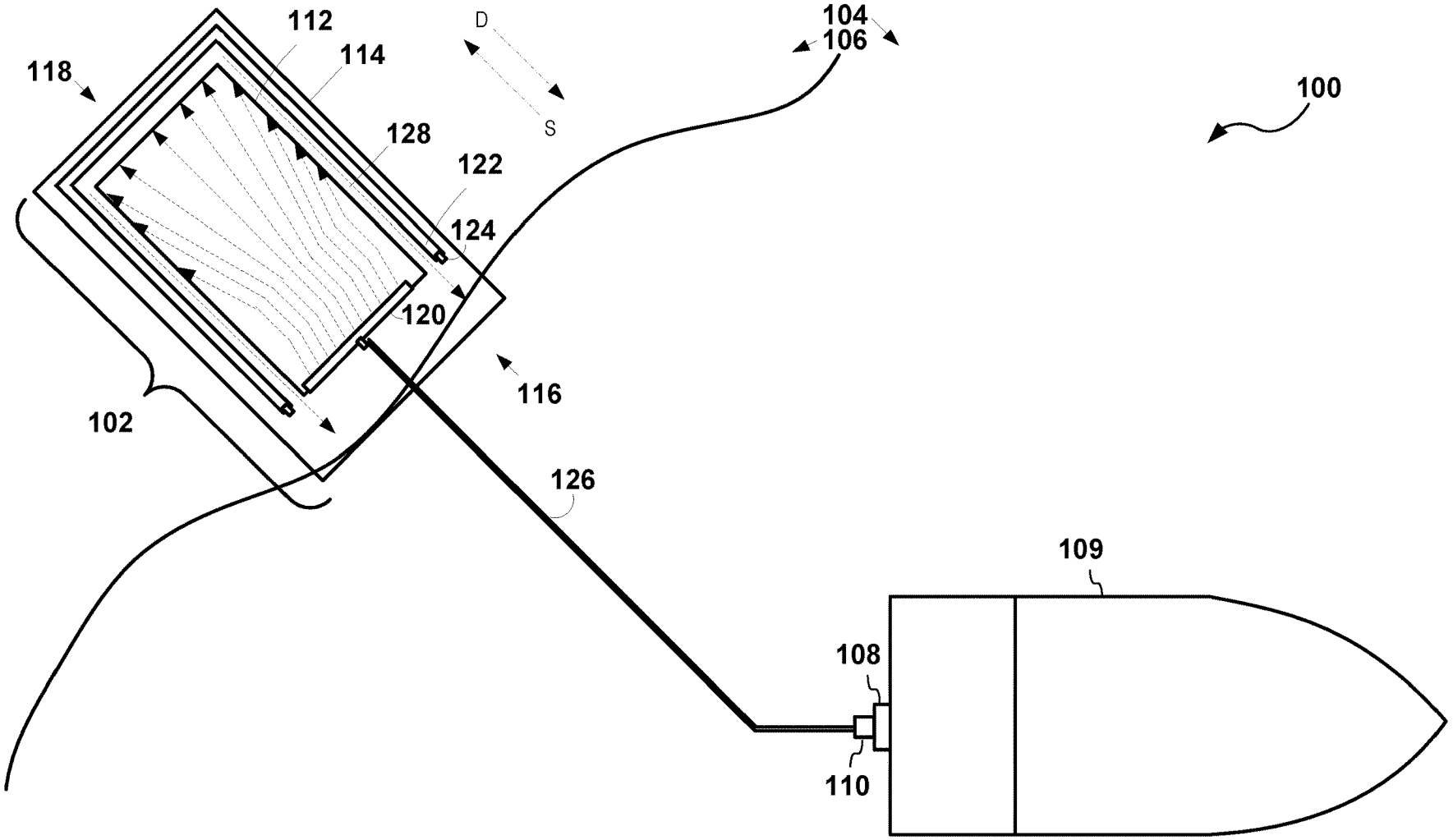
FIG. 1 illustrates an example of an artificial wave system.

An artificial water sports environment may induce water movement for water sports activities such as surfing, water skiing, body boarding, or other surface water sports. Flowing water may provide resistance or buoyancy for an enthusiast to perform the water sports activity. In present approaches, the artificial water sports environment may be assembled and remain stationary in a location such as an amusement park or other facility. For example, artificial water sports environments may include large equipment, such pumps and water reservoirs, which is not accommodating to rapid deployment and undeployment. Alternatively or in addition, the artificial water sports environments may include specialized pumps and connectors for operation of the artificial water sports environments.

Systems and methods for a portal water sports environment are provided. By way of introductory example, an artificial wave system may include a mat positioned on a liner. The liner may include a top surface, a bottom surface, a front end, and a back end opposite the front end. The front end of the liner may be positioned proximate to a body of water. The back end of the liner may be positioned distally to the body of water. The system may further include a spray nozzle positioned along a front end of the liner. The spray nozzle may spray water from the body of water onto the mat and toward the back end of the liner. The system may further include a ballast positioned on the top surface of the liner and spaced from the mat. The mat, the top surface of the liner, and the ballast may define a trench that extends away from the back end of the liner and toward the front end of the liner. The trench may guide water received from the spray nozzle toward the front end of the liner and into the body of water.

An example of a technical advantage of the systems and methods described herein may include rapid deployment and undeployment of an artificial water sports environment. For example, the artificial wave system may be transported or stored in a personal watercraft and then deployed to a beach side. Alternatively or in addition, the artificial wave system may be stored in a case that is towed or transported by vehicle or boat. The artificial wave system may receive water from a body of water such as a lake. The artificial wave system may include drainage features that drain water back into the body of water and/or minimize water erosion in the surrounding area. The artificial wave system may include flexible or foldable component(s), enabling the artificial wave system to be unrolled or unfolded during deployment. The ballast(s) of the artificial wave system may receive water to weight down the system during operation.

Another technical advantage of the system and method described herein is that the artificial wave system may be a personal watercraft may serve as a pump for the artificial wave system. For example, the artificial wave system may connect with a propulsion system of the personal watercraft via a personal watercraft attachment (PWC attachment). Accordingly, a specialized pump need not be transported for operation of the artificial wave system.

Another technical advantage of the systems and methods described herein may be that a body of water, such as a pond, stream, lake or ocean, may provide a source of water for simulating water sports activity. For example, the artificial wave system may receive water from the body of water instead of a large synthetic reservoir. The artificial wave system may be transported and/or stored without the large reservoir. Moreover, the water sports system may be rapidly deployed without waiting for the large reservoir to fill with water. Additional or alternative technical advantages are made apparent in the system and methods described herein.

FIG. 1 illustrates an example of an artificial wave system 100. The artificial wave system 100 may include a surf assembly 102. The surf assembly 102 may be positioned on or in a body of water 104. Alternatively or in addition, the surf assembly 102 may be positioned on a ground surface 106 adjacent to the body of water 104. The surf assembly 102 may receive pressurized water that originates from the body of water 104. The pressurized water may simulate water flow in surfboarding, wake boarding, water skiing, body boarding, or other surface water sports activities.

The system 100 may include a water source 108. The water source 108 may provide pressurized water to the surf assembly 102. For example, the water source 108 may include a propulsion system of a watercraft 109. The watercraft 109 may include, for example, a boat, a jet ski, or some other personal watercraft. The propulsion system may include a pump-jet or some other outlet of a watercraft in which pressurized water flows to propel the watercraft. The pressurized water from the propulsion system may be directed to the assembly 102. In other examples, the water source 108 may include a pump, such as a portable pump, that pumps water with power provided by an electric or mechanical engine.

In some examples, the surf assembly 102 may fluidly communicate with the water source 108 via a personal watercraft attachment (PWC attachment) 110. The PWC attachment 110 may connect to the watercraft 109 and receive pressurized water from the watercraft 109. Water from the PWC attachment 110 may flow to the surf assembly 102. In some examples, the PWC attachment 110 may detachably couple to the propulsion system of the watercraft 109. For example, the PWC attachment 110 may attach an outlet of a watercraft pump jet.

The surf assembly 102 may include a mat 112 and a liner 114. The mat 112 may receive pressurized water to simulate a wave for water sports activities. For example, the water may flow along the mat 112 to simulate water flow. The mat 112 may include of one or more materials to reduce friction and/or increase durability. For example, the mat 112 may include foam topped with an exterior shielding, such as polyvinyl chloride (PVC). The foam may include various thickness, but 2 inches may be suitable for some implementations. The foam may provide cushion, support and/or protection. For example, the foam layer may include a higher elasticity than the exterior shielding. The exterior shielding may protect the foam and provide a surface with a low coefficient of drag to aid in the water sports activity.

The liner 114 may include a barrier that separates the surf assembly 102 from a ground surface. The liner 114 may be water proof so that water flows along the surface of the liner. The liner 144 may have a higher coefficient of drag than the mat 112 (or the surface of the mat). For example, it may be preferable that the liner 114 be less slippery than the top of the mat 112 to prevent people or items from slipping on the liner 114. In some examples, the liner 114 may include a PVC or high density polyethylene (HDPE).

The liner 114 may receive water flowing from the mat 112. The liner 114 may guide water from the mat 112 back to the body of water 104. In some examples, the liner 114 may include a front end 116 and a back end 118. The front end 116 may be positioned closer to the body of water 104 than the back end 118. Water received by the liner 114 may flow toward the front end 116. For example, the liner 114, or a portion thereof, may be positioned on a beach that angles toward the body of water 104. Alternatively or in addition, the liner 114, or a portion thereof may be artificially angled to cause water to flow along the liner 114 and toward the body of water 104.

In some examples, the surf assembly 102 may further include a spray nozzle 120. The spray nozzle 120 may include a plurality of outlets that release pressurized water. The spray nozzle 120 may spray water from the body of water 104 onto or along the mat 112. For example, the spray nozzle 120 may be positioned along the front end 116 of the liner 114. The spray nozzle 120 may spray water toward the back end 118 of the liner 114 and/or away from the body of water 104. The spray nozzle 120 may fluidly communicate with the PWC attachment 110. Pressurized water from the propulsion system of the watercraft 109 may flow through the PWC attachment 110 and to the spray nozzle 120. The spray nozzle 120 may release the pressurized water onto the mat 112.

The water received by the spray nozzle 120 may apply forces to various components, such as the mat 112, of the surf assembly 102. Alternatively or in addition, the surf assembly 102 may be light in weight and susceptible to movement. Accordingly, it may be desirable to weight down the surf assembly 102 to prevent movement of the surf assembly or components thereof.

The system may include a ballast 122. The ballast 122 may include an internal cavity that receives a substance to hold the surf assembly 102 against the ground. For example, the ballast may include a container or a bag that receives water and/or air. The ballast 122 may inflate when receiving water and/or air. The ballast 122 may deflate when releasing water and/or air. The ballast 122 may be positioned on the liner 114. The ballast 122 may extend away a surface from the liner 114 and/or the ground. The ballast 122 may retain the liner 114 against the ground. For example, water received by the ballast 122 may serve as a weight for the liner 114 and/or mat 112.

In some examples, the ballast 122 may include a flexible material that can be folded or rolled for compact storage and quick deployment. Alternatively or in addition, the ballast 122 may be integral to the liner 114 and/or the mat 112. Accordingly, deployment of the system may involve unfolding or unrolling the liner 114, the mat 112, and/or the ballast 122. Undeployment of the system may involve folding and/or rolling the liner 114, the mat 112 and/or the ballast 122 as a unitary piece. In other examples, the ballast 122 may be placed on top of the liner 114. Alternatively or in addition, the ballast 122 may be detachably coupled to the liner 114. For example, the ballast 122 may be removably fastened with a mechanical fastener. Alternatively, the ballast 122 may be detachably fixed on the liner by way of a fastening materials, such as hook and loop.

The phrase "integral to" refers to a relationship between a component and a unitary structure. A first component is integral to a second component when the first component and the second component are each a separate portions of a unitary structure. In the examples described herein, the liner 114 may be integral to the mat 112 such that the liner and the mat 112 are each portions of a unitary structure comprising the liner 114 and mat 112. Alternatively or in addition, the ballast 122 may be integral to the liner 112 such that the ballast 122 and the liner 122 are each portions of a unitary structure.

In some examples, the ballast 122 may include a connection port 124. The connection port 124 may receive and release water and/or air. The connection port 124 may detachably couple with a water line 126 that fluidly communicates with the water source 108 to receive the pressurized water. For example, the connection port 124 may fluidly communicate with the PWC attachment 110 to receive pressurized water from the propulsion system of the watercraft 109. After the ballast 122 is filled, the water line 126 may be detached from the connection port 124 and then attached to the spray nozzle 120. Alternatively or in addition, the surf assembly 102 may include one or more valves that control the flow of water to the bag and/or the spray nozzle 120. In some examples, the surf assembly 102 may include one or more pressure regulator to ensure the water pressure to the ballast 122 and/or the spray nozzle 120 does not exceed a threshold pressure. Keeping the pressure below the threshold pressure may prevent damage to the spray nozzle 120, the ballast 122, or other components of the surf assembly 102.

Depending on the implementation, the surf assembly 102 may have various sizes and/or water pressure demands for proper operation. In some examples, multiple boats, pumps, or other examples of the water source may connect to the surf assembly 102. For example, one or more water lines may fluidly communicate with multiple water sources to provide pressurized water to the spray nozzle 120. In examples where the water source includes the watercraft 109, the watercraft 109 may include one or more pump jets that collectively pressurize water provided to the surf assembly 102. Alternatively or in addition, the system 100 may include one or more PWC attachments that connect to one or more watercraft and fluidly communicate with the surf assembly 102.

In some examples, the connection port 124 may serve as a drain for the water/air internal to the ballast 122. For example, the connection port 124 may include a drain hole. Water and/or air inside of the ballast 122 may drain from the ballast 122 in response to opening the drain hole. For example, the drain hole may be opened by removing a plug from the drain hole. In other examples, the drain hole may be separate and distinct from the connection port 124.

The surf assembly 102 may receive large quantities of water during operation. The surf assembly 102 may include various drainage features which cause water from the spray nozzle 120 to flow back to the body of water 104. For example, the surf assembly 102 may include a trench 128. The ballast 122, the liner 114 and/or the mat 112 may at least partially define the trench 128. For example, the ballast 122 may be spaced from liner 114. The trench 128 may be defined between the mat 112 and the ballast 122. Alternatively or in addition, a portion of the liner 114 exposed between the mat 112 and the ballast 112 may at least partially define the trench 128. The trench 128 may extend toward the body of water 104.

The trench 128 may receive water from the surf mast 112 and/or the spray nozzle 120. The trench 128 may guide the water back to the body of water 104. In some examples, the spray nozzle 120 may spray water in the spray direction S. The spray direction S may extend from the front 116 of the liner 114 and toward the rear 118 of the liner 114. Alternatively or in addition, the spray direction S may extend away from the body of water 104. The trench 128 may receive water and drain the water back into the body of water 104. The trench 128 may guide the water along the drainage direction D. The drainage direction D may be a direction opposite the spray direction S. Alternatively or in addition, the drainage direction D may extend toward the body of water 104.

Figure 2:
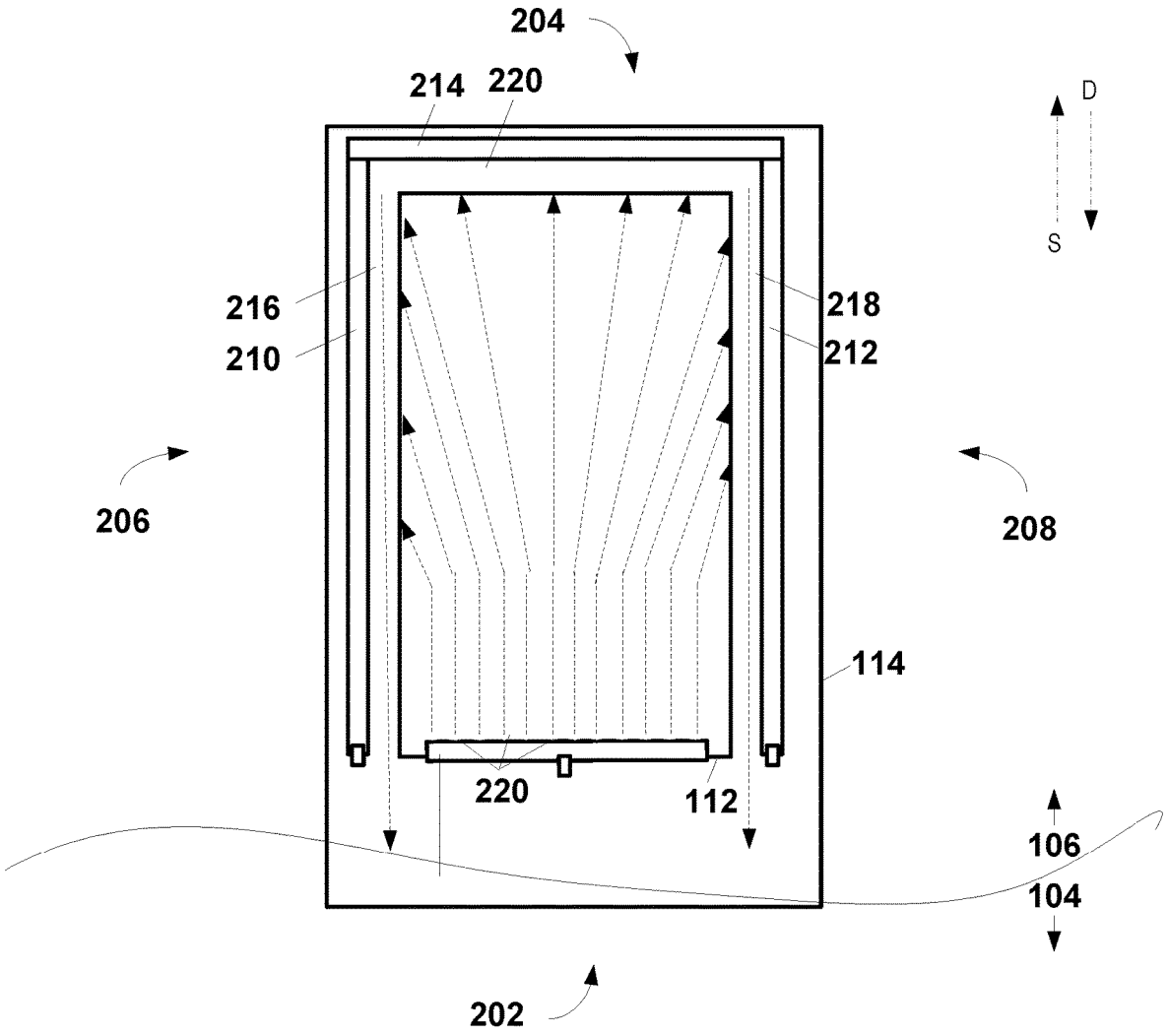
FIG. 2 illustrates a top view of an example of a surf assembly.

FIG. 2 illustrates a top view of an example of the surf assembly 102. The surf assembly 102 may include a front 202 and a back 204. The front 202 may be positioned proximally to the body of water 104 and the back 204 may be positioned distally from the body of water 104. Alternatively or in addition, the surf assembly 102 may include a first side 206 and a second side 208. The first side 206 and the second side 208 may extend between the front 202 and the rear 204 of the surf assembly 102. In some examples, the liner 114 may define an outer perimeter of the surf assembly 102. Alternatively, other components of the surf assembly 102 may at least partially define the outer perimeter.

In some examples, the surf assembly 102 may include multiple ballasts 210, 212, 214. The multiple ballast 210, 212, 214 may include, for example, a first ballast 210, a second ballast 212, and a third ballast 214. The first ballast 210 may be positioned along the first side 206 of the surf assembly 102. The second ballast 212 may be positioned along the second side 208 of the surf assembly 102. The third ballast 214 may be positioned along the rear 204 of the surf assembly 102. The third ballast 214 may extend between the first ballast 210 and the second ballast 212.

The ballasts 210, 212, 214 may include separate and district bags or containers. Alternatively, the ballast 210, 212, 214 may include a unitary bag. In other examples, the ballast 210, 212, 214 may include separate portions of a flexible unitary structure that includes one or more internal cavity for receiving air and/or fluid. The ballasts 210, 212, 214 may prevent water from the nozzle from spilling beyond the perimeter of the surf assembly 102. Alternatively or in addition, the ballasts 210, 212, 214 may weigh down the surf assembly 102. In other examples, the surf assembly 102 may include additional or alternative ballasts positioned at various locations on the surf assembly 102.

The surf assembly 102 may include drainage trenches 216, 218. The ballasts 210, 212, 214 may at least partially define each of the drainage trenches 216, 218, respectively. For example, the drainage trenches 216, 218 may include a first drainage trench 216 and a second drainage trench 218.

The first ballast 210, a top surface of the liner 114, and/or the mat 112 may define the first drainage trench 216. For example, the first ballast 210 may be spaced apart from the mat 112. The first drainage trench 216 may be defined between the first ballast 210 and the mat 112. The first drainage trench 216 may extend away from the rear 204 of the surf assembly 102 and toward the front of the surf assembly 102. Alternatively or in addition, the first drainage trench 216 may extend toward the body of water 104. The first drainage trench 216 may receive water from the mat 112 and guide the water toward or into the body of water 104.

The second ballast 212, the top surface of the liner 114, and/or the mat 112 may define the second drainage trench 218. The second ballast 212 may be spaced from the mat 112. The second drainage trench 218 may be defined between second ballast 212 and the mat 112. The second drainage trench 218 may extend away from the rear 204 of the surf assembly 102 and toward the front. Alternatively or in addition, the second drainage trench 218 may extend toward the body of water 104. The second drainage trench 218 may receive water from the mat 112 and guide the water toward or into the body of water 104.

In some examples, the surf assembly 102 may include an auxiliary trench 220. The auxiliary trench 220 may extend to one or more drainage trench. For example, the auxiliary trench 220 may extend between the first drainage trench 216 and the second drainage trench 218. The auxiliary trench 220 may be at least partially defined by the liner 114, the mat 112, and at least one ballast. For example, the third ballast bag 214 may be spaced from the mat 112. The auxiliary trench 220 may be defined between the third ballast bag 214 and the mat 112. In some examples, the auxiliary trench 220 may be positioned proximate to the back end of the surf assembly 102. The auxiliary trench 220 may receive water from the mat 112 and guide the water to the first drainage trench 216, the second drainage trench 218, and/or any other trench.

The nozzle may include a plurality of outlets 220 for releasing water. The outlets may be arranged in one or more rows of outlets. The outlets may cause the water to spray across or onto the mat 112. For example, the water released by the outlets may cause a sheet of pressurized water that extends at least partially along a surface of the mat 112.

Figure 3:
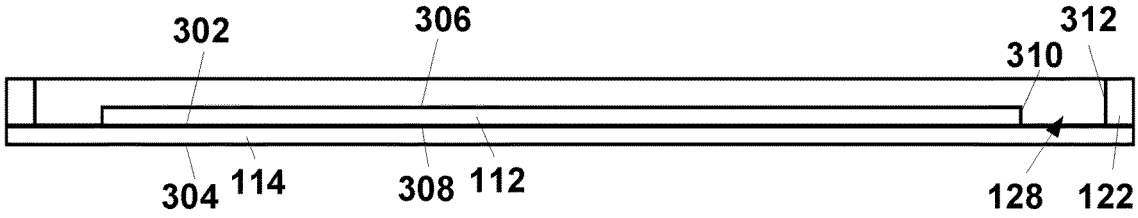
FIG. 3 illustrates a front view of an example of a surf assembly.

FIG. 3 illustrates a front view of an example of the surf assembly 102. The spray nozzle 120 is not visible in FIG. 3. The liner 114 may include a top surface 302 and a bottom surface 304. The bottom surface 304 may contact a ground beneath the liner 114. The top surface 302 may receive the mat 112. The mat 112 may include a top surface 306 and a bottom surface 308. The bottom surface 308 of the mat 112 may be positioned on the top surface 302 of the liner 114. The mat 112 may include a side surface 310. The ballast 122 may include an opposing side surface 312. The opposing side surface 312 may face the side surface 310 of the mat 112. The trench 128 may be defined between the side surface 310 of the mat 112 and the opposing side surface 312 of the ballast 122.

In some examples, the liner 114 may receive the mat 112. The mat 112 may extend away from the liner 114. The mat 112 may be permanently or detachably coupled to the liner 114. Alternatively, the mat 112 may be integral to the liner 114. For example, the mat 112 may be a raised portion of the liner 114 along the top surface 302. In other examples, the mat 112 may be a coating applied to the liner 114.

In some examples, the ballast 122 may be integral to the liner 114. For example, the ballast 122 may include a raised portion of the liner 114 with a hollow interior. When inflated with water and/or air, the ballast 122 may be higher than the mat 112, with respect to ground.

Figure 4:
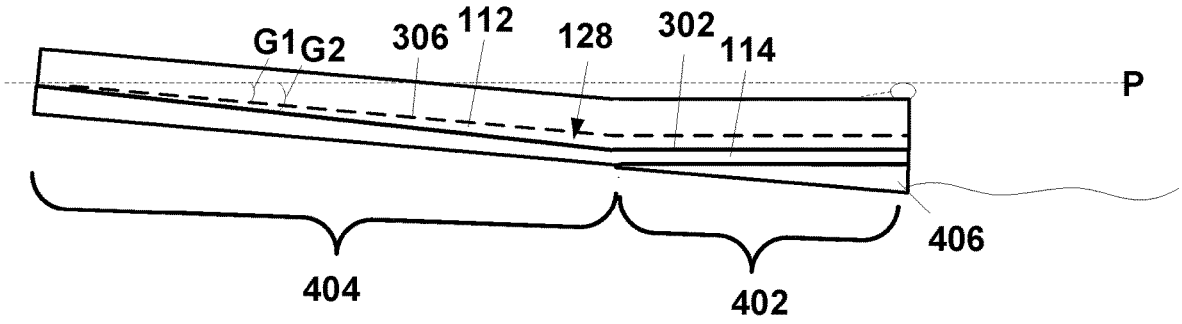
FIG. 4 illustrates a side view of an example of an artificial wave system.

FIG. 4 illustrates a side view of an example of the surf assembly 102 In some examples, the at least a portion of the trench 128 may be angled to follow a steeper slope than the mat 112. Angling the trench 128 may provide rapid drainage of water received by the trench 128.

The top surface 306 of the mat 112 may follow a first grade G1 with respect to a horizontal plane P. The top surface 302 of the liner 114 along the trench 128 may follow a second grade G2 with respect to the horizontal plane P. The second grade G2 may be steeper than the first grade G1, with respect to the horizontal plane P. For example, the first grade G1 and second grade G2 may be expressed as an acute angle of inclination with respect to the horizontal plane P. The absolute value of the second grate G2 may be greater than the absolute value of the first grade G1. Alternatively or in addition, the back end 118 of the liner 114 may be thicker than the front end 116 of the liner 114, and/or the rear end of the mat 112 may be thinner than the front end of the mat 112.

In some examples, the mat 112 may include a loading zone 402 and an operation zone 404. The loading zone 402 may include a portion of the mat 112 that is leveled. For example, the loading zone 402 may enable a user with bulky equipment to easily access the system 100 and prepare for operation. The operation zone 404 may include a portion of the mat 112 that is angled. During operation, gravity may pull a user down the slopped portion of the mat 112 while the pressurized water pushes the user up the sloped portion of the mat 112. In other examples, the outer surface 306 of the mat 112 along the operation zone 404 may follow varies contours.

In some examples, the system 100 may include a leveling ballast 406. The leveling ballast 406 may include an example of a ballast that is positioned beneath the liner 114 and/or mat 112. Alternatively or in addition, the leveling ballast 406 may be positioned along the front of the surf assembly 102. For example, the leveling ballast 406 may include a container or a bag that receives and releases water and/or air. In some examples, the leveling ballast 406 may include a flexible material. The ballast 406 may inflate when receiving water and/or air. The ballast may deflate when releasing water and/or air. In some examples, the leveling ballast may be integral with the one or additional ballast so that the ballasts are simultaneously inflated and/or deflated.

As the ballast fills with water, a top surface of the leveling ballast 406 may level with respect to gravity. The top surface of the leveling ballast 406 may support at least a portion of the liner 114 and/or the mat 112 along the loading zone 402. The leveling ballast 406 may cause the mat 112 along the loading zone 402 to become substantially level.

Figure 5:
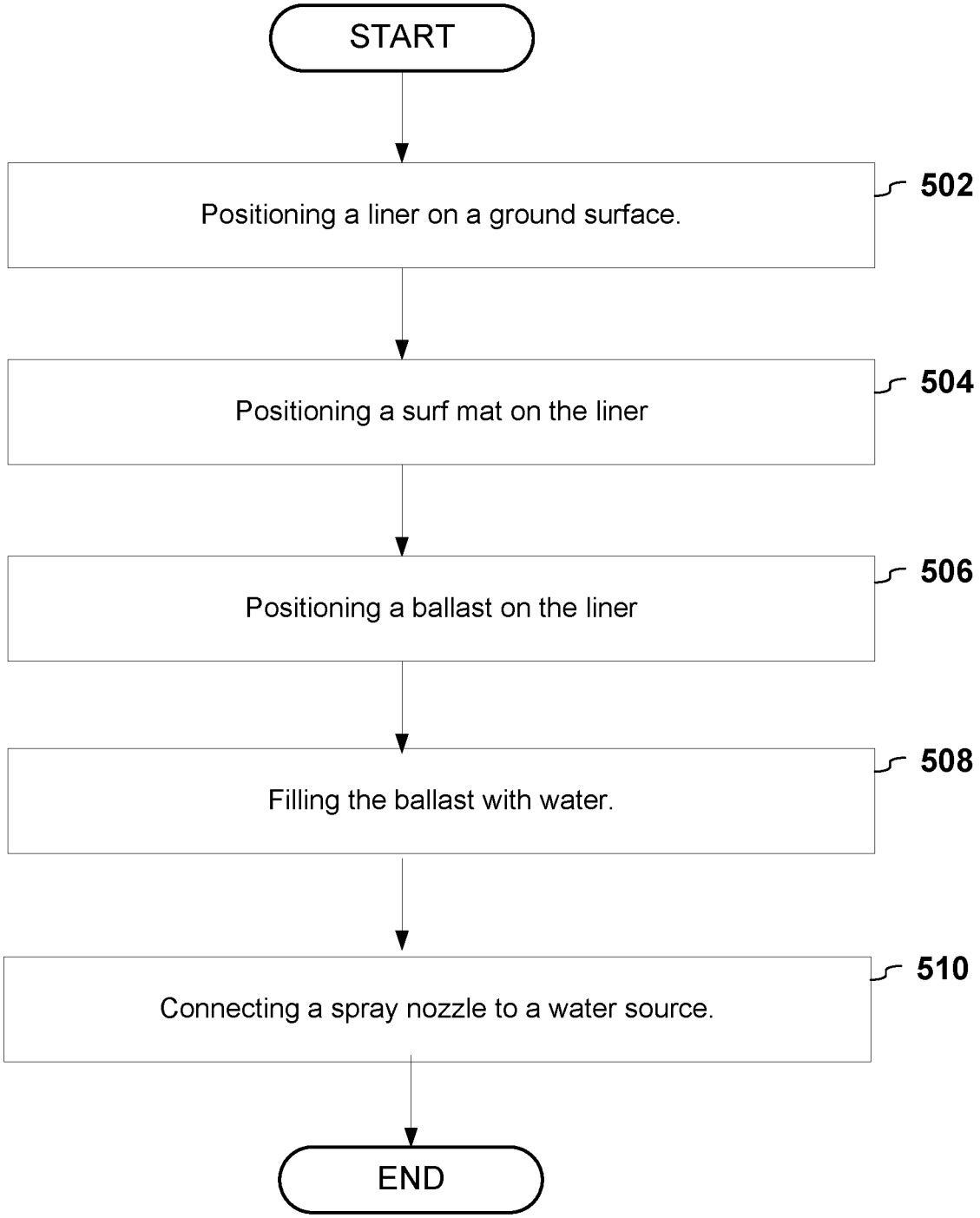
FIG. 5 illustrates a flow diagram of an example of steps to assembly an artificial wave system.

FIG. 5 illustrates a flow diagram of an example of steps to assemble the system 100. The steps may include additional, different, or fewer operations than illustrated in FIG. 5. The steps may be executed in a different order than illustrated in FIG. 5.

Assembly of the system 100 may include positioning the liner 114 on a ground surface 106 (502). The ground surface 106 may include, for example, a beach surface. The liner 114 may be unrolled or unfolded prior to positioning on the ground surface 106. A front end of the liner 114 may be positioned in or proximate to a body of water 104. A back end 118 of the liner 114 may be positioned distally from the body of water 104.

Assembly may further involve positioning a mat 112 on the liner 114 (504). For example, the mat 112 may be unrolled or unfolded and then placed on top of the liner 114.

The assembly may further involve positioning the ballast 122 on the liner 114 (506). The ballast 122 may be in a deflated state when it is placed on the liner 114. In some examples, a plurality of ballasts may be positioned along a perimeter of the liner 114. The ballast 122 may be spaced from an edge of the mat 112 to define a trench 128 between the mat 112 and the ballast 122. The trench 128 may extend toward the body of water 104.

The assembly may further include filling the ballast 122 (or ballasts) with water (508). Filling the ballasts with water may include connecting a water line 126 to the ballast 122. The water line 126 may include or be in fluid communication with the PWC attachment 110. Assembly may further include connecting the PWC attachment 110 to a watercraft. Water pressurized by the watercraft may flow to the ballast 122 via the PWC attachment 110.

Assembly may further include connecting the spray nozzle 120 with a water source 108 (510). For example, the spray nozzle 120 may be connected with a watercraft jet using the PWC attachment 110. The spray nozzle 120 may receive pressurized water that flows from the watercraft via the PWC attachment 110. The spray nozzle 120 may spray pressurized water onto or the mat 112.

In some examples, the mat 112, the liner 114 and/or the ballast 122 may be a flexible material that unfolds or unrolls as part of the assembly. Alternatively or in addition, the mat 112, the liner 114, and/or the ballast 122 may be integral and unroll/unfold as a unitary structure. The ballast 122 may include a portion of the unitary structure that inflates with water to define drainage trenches and/or weigh down the system.

In some examples, assembly may further include positioning the spray nozzle 120 proximate to the liner 114. For example, the spray nozzle 120 may be positioned near a front end of the liner 114. The spray nozzle 120 may be placed on the top of the liner 114 next to the mat 112. In some examples, the spray nozzle 120 may detachably couple to the liner 114.

Assembly may further include positioning a leveling ballast underneath the liner 114 and/or mat 112. The leveling ballast may be filled with water. Filing the leveling ballast may cause at least a portion of the liner 114 and/or the mat 112 to become level, with respect to ground.

The system 100 may be implemented with additional, different, or fewer components. Alternately or in addition, the system may be implemented with a portion of the components described herein.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

While various embodiments have been described, it will be apparent to those of ordinary skill in the art that many more embodiments and implementations are possible. Accordingly, the embodiments described herein are examples, not the only possible embodiments and implementations.

What is claimed:

1. An artificial wave system comprising:

a mat positioned on a liner, the liner comprising a top surface, a bottom surface, a front end, and a back end opposite the front end, the front end of the liner configured to be proximate to a body of water, and the back end of the liner configured to be distal to the body of water;

a spray nozzle positioned along a front end of the liner, the spray nozzle configured to spray water from the body of water onto the mat and toward the back end of the liner; and a ballast positioned on the top surface of the liner and spaced from the mat, wherein the mat, the top surface of the liner, and the ballast define a trench that extends away from the back end of the liner and toward the front end of the liner, wherein the trench is configured to guide water received from the spray nozzle toward the front end of the liner and into the body of water.

2. The artificial wave system of claim 1, wherein the spray nozzle is in fluid communication with a personal watercraft attachment, the personal watercraft attachment configured to detachably couple to a jet of watercraft configured to receive water from the body of water.

3. The artificial wave system of claim 1, wherein the ballast is configured to be inflated with water provided via a personal watercraft attachment detachably coupled to a propulsion system for a personal watercraft.

4. The artificial wave system of claim 1, wherein the ballast comprises a first ballast and the trench comprises a first trench, the portable artificial wave system further comprising:

a second ballast positioned on the top surface of the liner and spaced from the mat, wherein the first ballast positioned along a first side of the mat and the second ballast positioned along a second side of the mat, wherein the second side of the mat, the second ballast, and the top surface of the liner define a second trench configured to guide the water from the spray nozzle toward the front end of the liner.

5. The artificial wave system of claim 4, further comprising:

a third ballast positioned proximate to the back end of the liner and spaced from the mat, wherein the mat, the third ballast and the top surface of the liner define a third trench that extends between the first trench and the second trench.

6. The artificial wave system of claim 1, wherein the ballast comprises a first ballast, the portable artificial wave system further comprising:

a second ballast positioned beneath the bottom surface of the liner, wherein the second ballast is configured to level at least a portion of the mat in response to being filled with water.

7. The artificial wave system of claim 1, wherein an outer surface of the mat comprises a lower coefficient of drag than the top surface of the liner.

8. A system, comprising:

a liner comprising a top surface and a bottom surface, wherein the bottom surface is configured to contact a ground surface beneath the liner;

a mat positioned on the top surface of the liner, the mat configured to receive water sprayed along a first direction by a spray nozzle to simulate a wave; and a ballast positioned on the top surface of the liner and spaced from the mat, wherein the mat, the top surface of the liner, and the ballast define a trench configured receive water from the mat and guide the water along a second direction opposite the first direction.

9. The system of claim 8, wherein the spray nozzle is configured to receive water from a jet of a watercraft.

10. The system of claim 8, wherein the ballast is configured to be inflated with water pumped from a watercraft.

11. The system of claim 8, wherein the ballast extends further away from the top surface of the liner than the mat.

12. The system of claim 8, wherein a front end of the liner is configured to be placed in a body of water and a back end of the liner is configured to be position on the ground surface, wherein the trench extends away from the back end of the liner and toward the front end of the liner to release water into the body of water at the front end of the liner.

13. The system of claim 8, wherein the mat, the ballast, or any combination thereof is integral to the liner.

14. The system of claim 8, wherein the mat, the ballast, or any combination thereof, is detachably coupled to the liner.

15. A method comprising:

positioning a liner on a beach surface so that a front end of the liner is located in or proximate to a body of water and a back end of the liner is located distally from the body of water;

positioning a mat on the liner;

positioning a ballast on the liner, the ballast spaced from an edge of the mat to define a trench between the mat and the ballast that extends toward the body of water; and filling the ballast with water to retain the liner on the beach surface.

16. The method of claim 15, wherein filling the ballast with water further comprises:

filling the ballast with water flowing from a jet of a watercraft.

17. The method of claim 15, further comprising:

connecting a personal watercraft attachment to a watercraft jet; and spraying water onto the mat from a nozzle in fluid communication with the personal watercraft attachment.

18. The method of claim 15, further comprising positioning a spray nozzle at a front of the liner.

19. The method of claim 15, further comprising:

positioning a leveling ballast underneath the liner; and filling the leveling ballast with water to cause at least a portion of the liner to become level.

20. The method of claim 15, further comprising:

unfolding the ballast, the liner, the mat, or any combination thereof.

* * * * *